US008519898B2

(12) United States Patent
Sampo et al.

(10) Patent No.: US 8,519,898 B2
(45) Date of Patent: Aug. 27, 2013

(54) ANTENNA DEVICE

(75) Inventors: Takeshi Sampo, Gunma (JP); Noritaka Terashita, Gunma (JP); Kazuya Matsunaga, Gunma (JP); Masashi Nagami, Gunma (JP)

(73) Assignee: Yokowo Co., Ltd., Tokyo (JP)

( * ) Notice: Subject to any disclaimer, the term of this patent is extended or adjusted under 35 U.S.C. 154(b) by 254 days.

(21) Appl. No.: 13/194,092

(22) Filed: Jul. 29, 2011

(65) Prior Publication Data

US 2012/0026050 A1 Feb. 2, 2012

(30) Foreign Application Priority Data

Jul. 30, 2010 (JP) ..... P2010-172731

(51) Int. Cl.
*H01Q 9/00* (2006.01)

(52) U.S. Cl.
USPC ..... 343/749; 343/752

(58) Field of Classification Search
USPC ..... 343/700 MS, 702, 745, 749, 752, 343/895
See application file for complete search history.

(56) References Cited

U.S. PATENT DOCUMENTS 5,835,067 A * 11/1998 Goodman ..... 343/722
6,611,235 B2 * 8/2003 Barna et al. ..... 343/702
6,856,292 B2 * 2/2005 Kuramoto et al. ..... 343/702
2010/0013724 A1 1/2010 Ohshima et al.
2010/0265147 A1 10/2010 Wakui et al.

FOREIGN PATENT DOCUMENTS

GB 2 251 981 A 7/1992
JP 2009-135741 6/2009
JP 2010-021856 1/2010

OTHER PUBLICATIONS

Extended European Search Report dated Apr. 4, 2013, for International application No. 11006286.6.

* cited by examiner

*Primary Examiner* — Tan Ho
(74) *Attorney, Agent, or Firm* — Morgan, Lewis & Bockius LLP

(57) ABSTRACT

An antenna device includes: an antenna base plate having a shape of a flat plate; a capacity loading plate of a top capacity loaded type monopole antenna, the capacity loading plate arranged in parallel with the antenna base plate; and a planar antenna arranged between the antenna base plate and the capacity loading plate. A size of at least a part of the capacity loading plate in a direction of width of the capacity loading plate is less than about ¼ wavelength of receiving frequency of the planar antenna, and edges of the capacity loading plate in the direction of width of the capacity loading plate are folded back so that the capacity loading plate has a meander shape extending in a direction of length of the capacity loading plate.

2 Claims, 15 Drawing Sheets

FIG. 3

AVERAGE GAIN AT ELEVATION ANGLE OF 10 DEGREE OR MORE [dBic]

| | | WIDTH W [mm] | | | | | |
|---|---|---|---|---|---|---|---|
| | | 20 | 30 | 50 | 55 | 75 | 100 |
| LINE INTERVAL D [mm] | 1 | 4.25 | 4.35 | 4.25 | 3.78 | 2.98 | 1.73 |
| | 2.5 | 4.08 | 4.15 | 3.91 | 3.40 | 2.49 | 0.93 |
| | 5 | 3.97 | 4.00 | 3.64 | 2.85 | 2.04 | 0.00 |

FIG. 5

AVERAGE GAIN AT ELEVATION ANGLE OF 10 DEGREE OR MORE [dBic]

| | | WIDTH W [mm] | | | | | |
|---|---|---|---|---|---|---|---|
| | | 20 | 30 | 40 | 50 | 55 | 100 |
| HEIGHT H [mm] | 10 | 2.33 | 2.98 | 2.62 | 2.44 | 1.34 | −6.89 |
| | 20 | 3.58 | 3.94 | 4.19 | 3.95 | 3.29 | −0.89 |
| | 30 | 4 | 4.27 | 4.5 | 4.4 | 3.88 | 3.65 |
| | 40 | 4.2 | 4.36 | 4.51 | 4.35 | 3.86 | 2.5 |
| | 50 | 4.25 | 4.35 | 4.44 | 4.25 | 3.78 | 1.73 |

FIG. 8

GAIN OF FM ANTENNA [dB]

| | | FREQUENCY [MHz] | | | | | | | | | | |
|---|---|---|---|---|---|---|---|---|---|---|---|---|
| | | 88 | 90 | 92 | 94 | 96 | 98 | 100 | 102 | 104 | 106 | 108 |
| LINE INTERVAL [mm] | 1 | −18.73 | −17.47 | −17.2 | −17.09 | −17.07 | −17.7 | −19.55 | −21.86 | −24.59 | −26.89 | −27.13 |
| | 5 | −19.02 | −17.74 | −17.41 | −17.2 | −17.14 | −17.84 | −19.33 | −21.73 | −24.61 | −26.79 | −26.44 |
| | 20 | −19.52 | −18.14 | −17.71 | −17.4 | −17.34 | −18.04 | −19.43 | −21.93 | −24.91 | −27.19 | −27.82 |
| | 50 | −20.52 | −18.94 | −18.31 | −17.8 | −17.64 | −18.18 | −19.63 | −22.33 | −25.51 | −27.99 | −29.04 |
| PLATE-LIKE SHAPE | | −18.81 | −17.54 | −17.22 | −17.01 | −16.84 | −17.29 | −19.06 | −21.43 | −24.21 | −26.48 | −26.78 |

ANTENNA DEVICE

BACKGROUND OF THE INVENTION

The present invention relates to an antenna device in which an FM antenna for receiving FM broadcast and a planar antenna for receiving GPS signals and/or satellite digital radio broadcast, and so on are incorporated.

In an antenna device installed on a vehicle, antennas for receiving FM broadcast, satellite digital broadcast and/or GPS signals are respectively required. However, in case where these antennas are separately arranged, an outer appearance would be unattractive, and for this reason, a plurality of antennas are incorporated in a single casing of such antenna device. Moreover, as the antenna device, a compact and low profile antenna device is desirable. Therefore, use of a top capacity loaded type monopole antenna is considered in place of a rod antenna. Examples using such top capacity loaded type monopole antenna are disclosed in JP-A-2010-21856 and JP-A-2009-135741. In the antenna device disclosed in JP-A-2010-21856, both an FM antenna and a planar antenna for receiving GPS signals are incorporated. In the antenna device disclosed in JP-A-2009-135741, an FM antenna and a planar antenna for receiving satellite digital broadcast are incorporated.

In the art disclosed in JP-A-2010-21856, a capacity loading plate of the top capacity loaded type monopole antenna to be used as the FM antenna is arranged at a position separated upward from an antenna base plate and in parallel with a flat surface of the antenna base plate. Therefore, it is possible to realize an antenna device having a relatively low profile. However, in case where a planar antenna is disposed on the antenna base plate and below the capacity loading plate, it is predicted that gain of the planar antenna would be deteriorated due to influence of the capacity loading plate.

Moreover, in the art disclosed in JP-A-2009-135741, a monopole antenna which is used as the FM antenna is uprightly provided on an antenna base plate. Therefore, it is predicted that a planar antenna disposed on the antenna base plate and below the FM antenna would be unlikely to be influenced by the FM antenna. However, because the FM antenna is uprightly provided with respect to the antenna base plate, it is impossible to realize the antenna device having a low profile.

The inventors of the invention arranged, as a first step, a capacity loading plate of the top capacity loaded type monopole antenna to be used as the FM antenna, at a position separated upward from an antenna base plate and in parallel with a flat surface of the antenna base plate, and disposed a planar antenna on the antenna base plate and below the capacity loading plate, in the same manner as in the art disclosed in JP-A-2010-21856. Then, the inventors carried out measurements for confirming what extent the gain of the planar antenna would be deteriorated due to the influence of the capacity loading plate. FIG. 14 is a perspective view of a simulation model for measuring the gain of a GPS patch antenna which is disposed below the capacity loading plate. A GPS patch antenna 12 which is the planar antenna is disposed at a center of a ground plane 10, and a capacity loading plate 14 of a top capacity loaded type monopole antenna is arranged above the GPS patch antenna 12, at a position of a height H of 50 mm. A length L of this capacity loading plate 14 is 100 mm, and a width W thereof is 30 mm. FIG. 15 shows changes in the gain of the GPS patch antenna 12, in the structure as shown in FIG. 14, in case where a center of the capacity loading plate 14 is displaced from a center of the GPS patch antenna 12 in directions of width and length. The GPS patch antenna 12 has again of 7 dBic in a direction of zenith, unless the capacity loading plate 14 is provided. The gain decreases to 3 to 4 dBic, when the GPS antenna 12 is displaced from the center of the capacity loading plate 14 in a range of about ±25 mm in the direction of width and about ±30 mm in the direction of length, and the gain is relatively decreased. The gain decreases to 4 to 5 dBic, when the GPS antenna 12 is displaced from the center of the capacity loading plate 14 in a range of about ±45 mm in the direction of width and about ±50 mm in the direction of length, and the gain is remarkably decreased. It is possible to reduce such influence of the capacity loading plate 14, by remarkably displacing the center of the capacity loading plate 14 from the center of the GPS patch antenna 12. However, in this case, an area for installing the antenna device is increased.

Under the circumstances, it is desired that the antenna device is made low profiled by arranging the capacity loading plate of the top capacity loaded type monopole antenna to be used as the FM antenna, at the position separated upward from the antenna base plate and in parallel with the flat surface of the antenna base plate, as in the art disclosed in JP-A-2010-21856, and moreover, the planar antenna disposed on the antenna base plate and below the capacity loading plate is not influenced by the capacity loading plate.

SUMMARY

It is therefore an object of the invention to provide an antenna device in which a capacity loading plate of a top capacity loaded type monopole antenna is arranged at a position separated upward from an antenna base plate in a shape of a flat plate and in parallel with a flat surface of the antenna base plate, and moreover, a planar antenna which is disposed on the antenna base plate and below the capacity loading plate is not influenced by the capacity loading plate.

In order to achieve the object, according to the invention, there is provided an antenna device comprising: an antenna base plate having a shape of a flat plate; a capacity loading plate of a top capacity loaded type monopole antenna, the capacity loading plate being arranged in parallel with the antenna base plate; and a planar antenna arranged between the antenna base plate and the capacity loading plate, wherein a size of at least a part of the capacity loading plate in a direction of width of the capacity loading plate is less than about ¼ wavelength of receiving frequency of the planar antenna, and edges of the capacity loading plate in the direction of width of the capacity loading plate are folded back so that the capacity loading plate has a meander shape extending in a direction of length of the capacity loading plate.

The edges of the capacity loading plate in the direction of width of the capacity loading plate may be closer to the antenna base plate than a center part of the capacity loading plate in the direction of width of the capacity loading plate so that the capacity loading plate has a convex shape, and a length of a line from one edge to the other edge of the capacity loading plate in the direction of width of the capacity loading plate may be less than about ¼ wavelength of the receiving frequency of the planar antenna.

BRIEF DESCRIPTION OF THE DRAWINGS

FIG. 3 is a table showing data of average gains obtained at an elevation angle of 10 degree or more, which were measured by varying a width W of the capacity loading plate and an interval D between lines in a meander shape, in the measuring model in FIG. 2.

FIG. 5 is a table showing data of average gains obtained at the elevation angle of 10 degree or more, which were measured by varying the width W and a height H of the capacity loading plate, in the measuring model in FIG. 2.

FIG. 8 is a table showing data of the gains with respect to change of frequency waves, which were measured in case where the interval between the lines in the meander shape of the capacity loading plate was varied, and in case where the capacity loading plate was formed in a plate-like shape.

DETAILED DESCRIPTION OF EMBODIMENTS

Figure 1A:
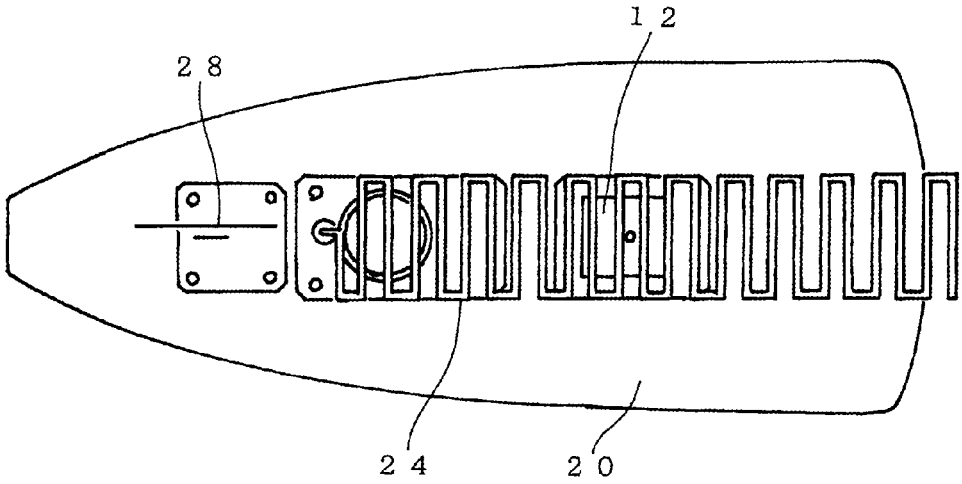
FIG. 1A is a plan view showing a structure of an antenna device in a first embodiment of the invention.
Figure 1B:
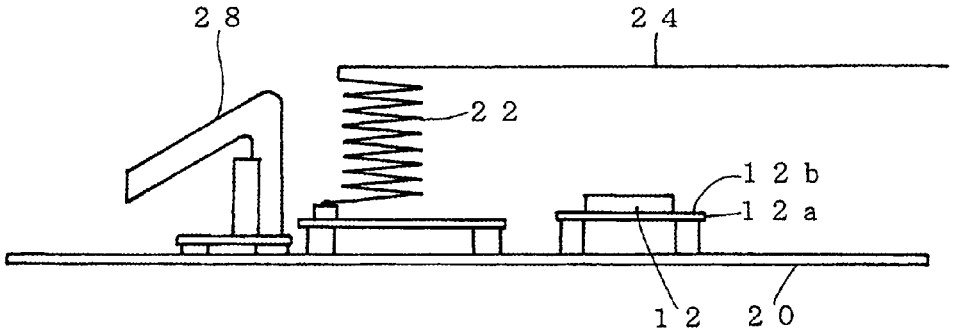
FIG. 1B is a front view of the same.
Figure 1C:
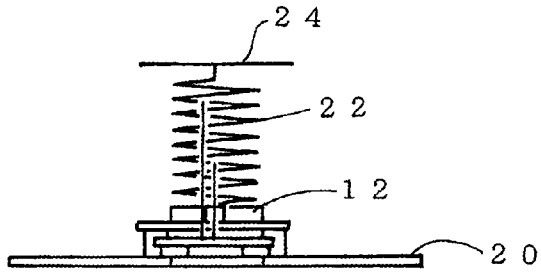
FIG. 1C is a left side view of the same.
Figure 2:
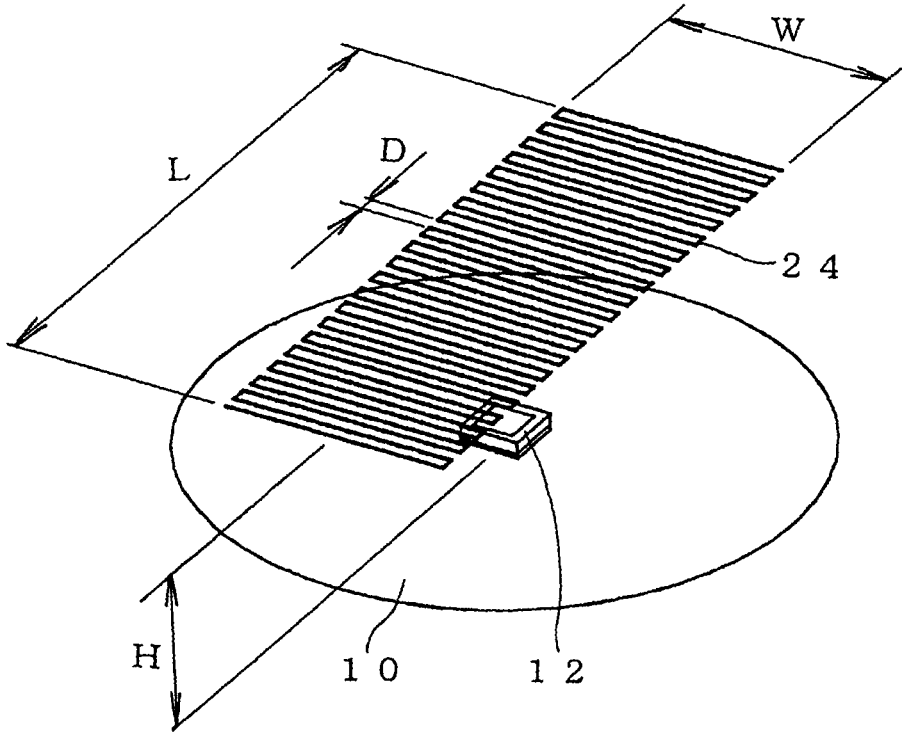
FIG. 2 is a perspective view of a measuring model for obtaining a capacity loading plate having such a structure that gain of a planar antenna which is disposed below would not be deteriorated.
Figure 4:
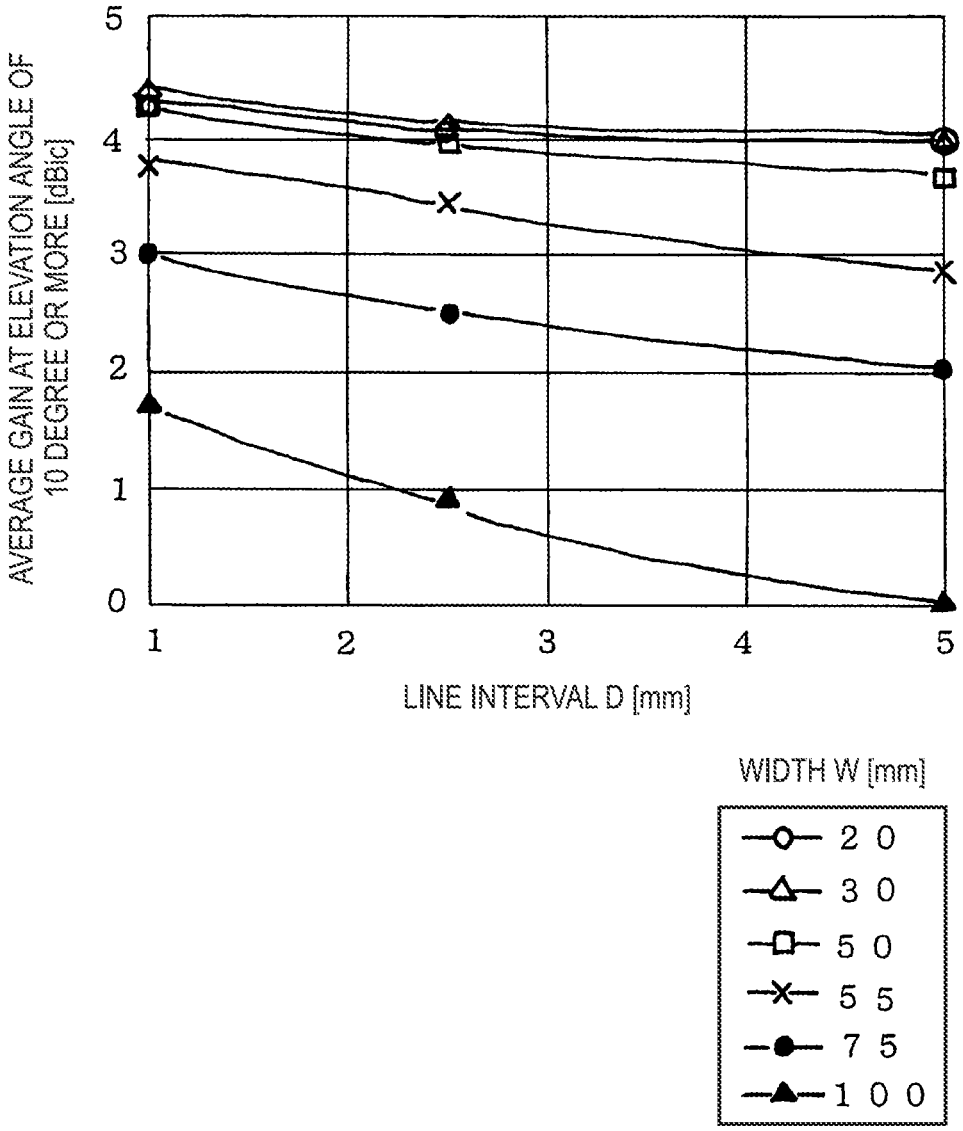
FIG. 4 is a graph showing the measured data in FIG. 3.
Figure 6:
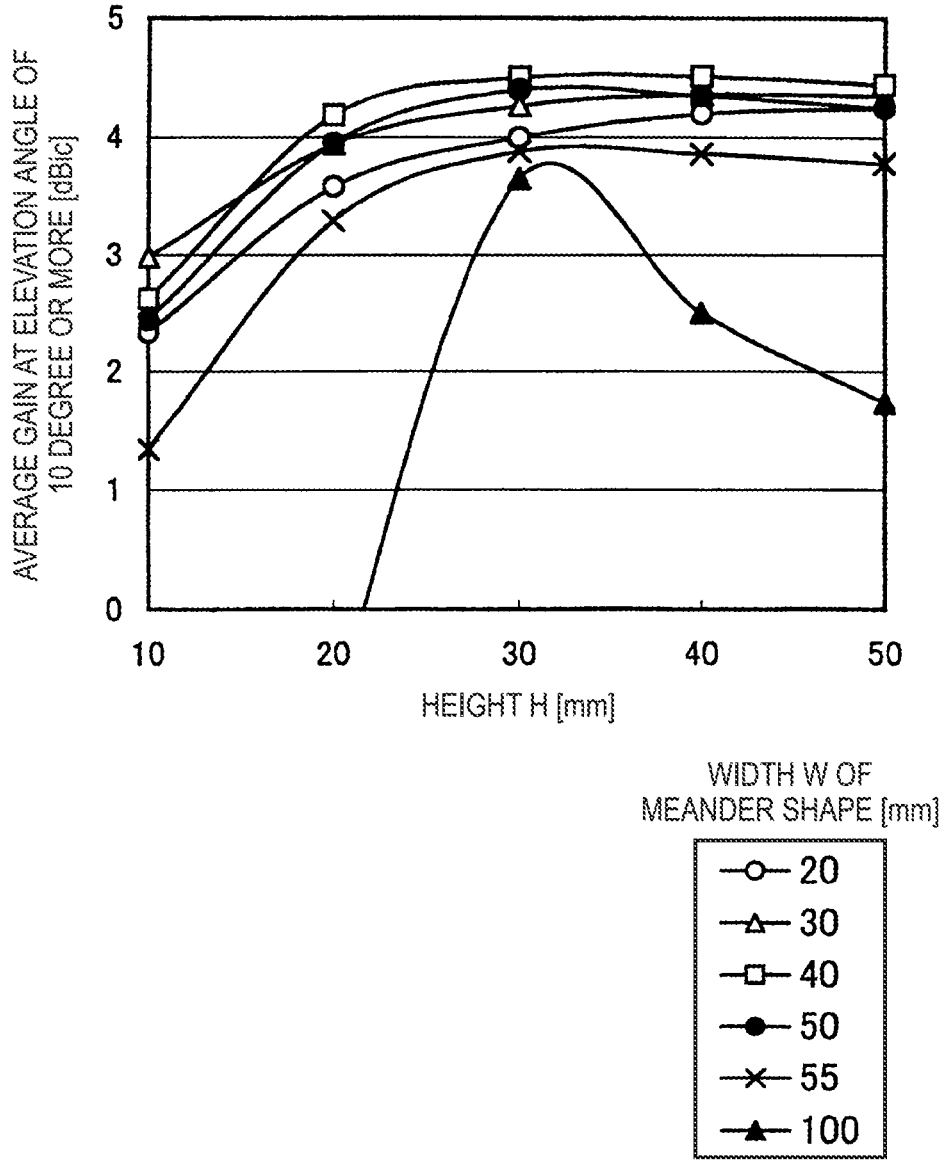
FIG. 6 is a graph showing the measured data in FIG. 5
Figure 7A:
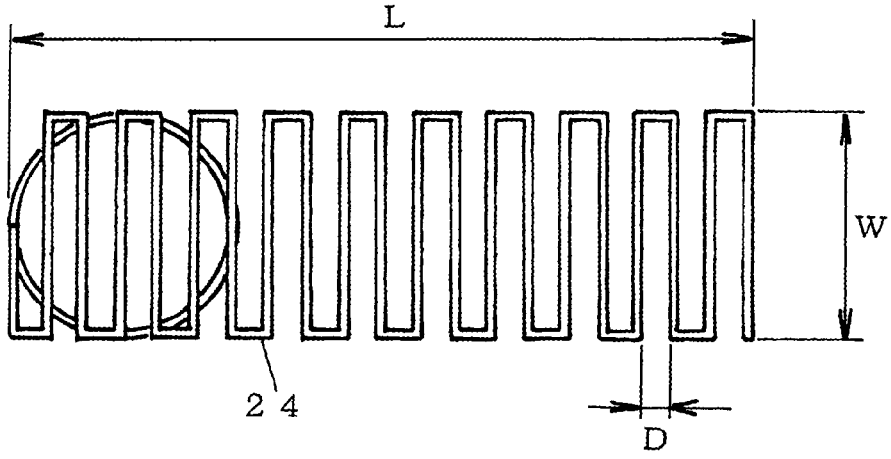
FIG. 7A is a plan view of a measuring model for measuring the gain as an FM antenna.
Figure 7B:
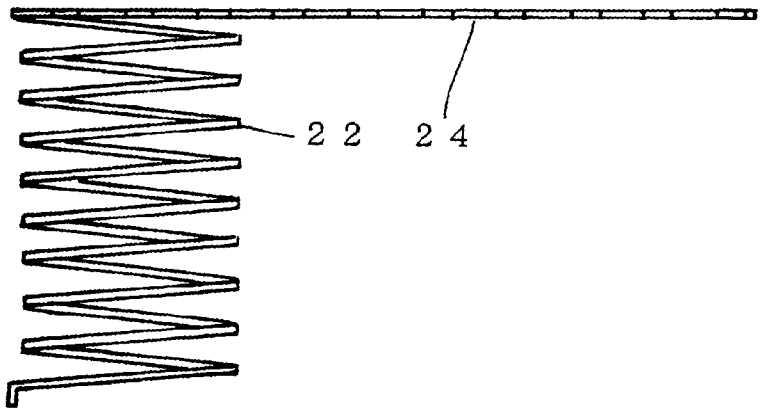
FIG. 7B is a front view of the same.

Now, a first embodiment of the invention will be described referring to FIGS. 1A to 8. FIG. 1A is a plan view showing a structure of an antenna device in the first embodiment of the invention, FIG. 1B is a front view of the same, and FIG. 1C is a left side view of the same. FIG. 2 is a perspective view of a measuring model for obtaining a capacity loading plate having such a structure that gain of a planar antenna which is disposed below would not be deteriorated. FIG. 3 is a table showing data of average gains obtained at an elevation angle of 10 degree or more, which were measured by varying a width W of the capacity loading plate and an interval D between lines in a meander shape, in the measuring model in FIG. 2. FIG. 4 is a graph showing the measured data in FIG. 3. FIG. 5 is a table showing data of average gains obtained at the elevation angle of 10 degree or more, which were measured by varying the width W and a height H of the capacity loading plate, in the measuring model in FIG. 2. FIG. 6 is a graph showing the measured data in FIG. 5. FIG. 7A is a plan view of a measuring model for measuring the gain as an FM antenna, and FIG. 7B is a front view of the same. FIG. 8 is a table showing data of the gains with respect to change of frequency waves, which were measured in case where the interval between the lines in the meander shape in the capacity loading plate was varied, and in case where the capacity loading plate was formed in a plate-like shape.

In the antenna device in the first embodiment of the invention as shown in FIGS. 1A to 1C, a coil element 22 is uprightly provided on an antenna base plate 20 with its axis directed in a vertical direction, and a tip end of a capacity loading plate 24 which is an element in a meander shape is electrically connected to a distal end of the coil element 22. A top capacity loaded type monopole antenna is thus composed of an inductance component of this coil element 22 and a capacitance component of the capacity loading plate 24, and used as an FM antenna. The capacity loading plate 24 is on one plane, and arranged above the antenna base plate 20 at a position separated from the antenna base plate 20 by a height H, and substantially in parallel with a flat surface of the antenna base plate 20. The capacity loading plate 24 is set in a meander shape, by being alternately folded in C-shape including two angles, at respective edges in a direction of width W, so as to extend in a direction of length L at an interval D between lines. Below this capacity loading plate 24, a GPS patch antenna 12 for receiving GPS signals as a planar antenna is disposed on the antenna base plate 20. The GPS patch antenna 12 has a base plate 12*a* and a ground plane 12*b* provided on a whole upper face of the base plate 12*a*. Further, an antenna 28 for receiving mobile phone signals is disposed on the antenna base plate 20, in a region which is not covered with the capacity loading plate 24. It is to be noted that the FM antenna is used also as an antenna for receiving AM broadcast. In this manner, a plurality of antennas for receiving the FM broadcast, AM broadcast, mobile phone signals, and GPS signals are incorporated in the antenna device according to the first embodiment.

Figure 14:
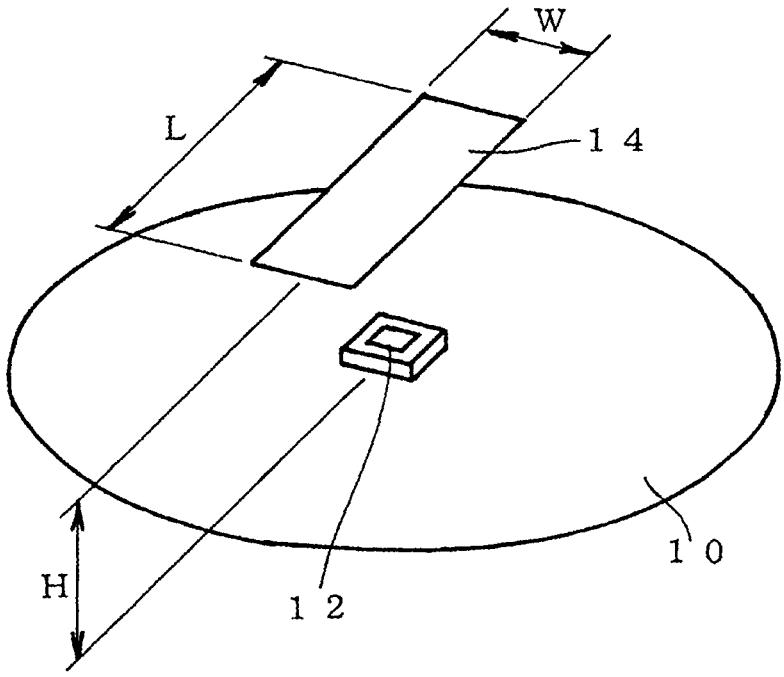
FIG. 14 is a perspective view of a simulation model for measuring the gain of the GPS patch antenna which is arranged below the capacity loading plate.
Figure 15:
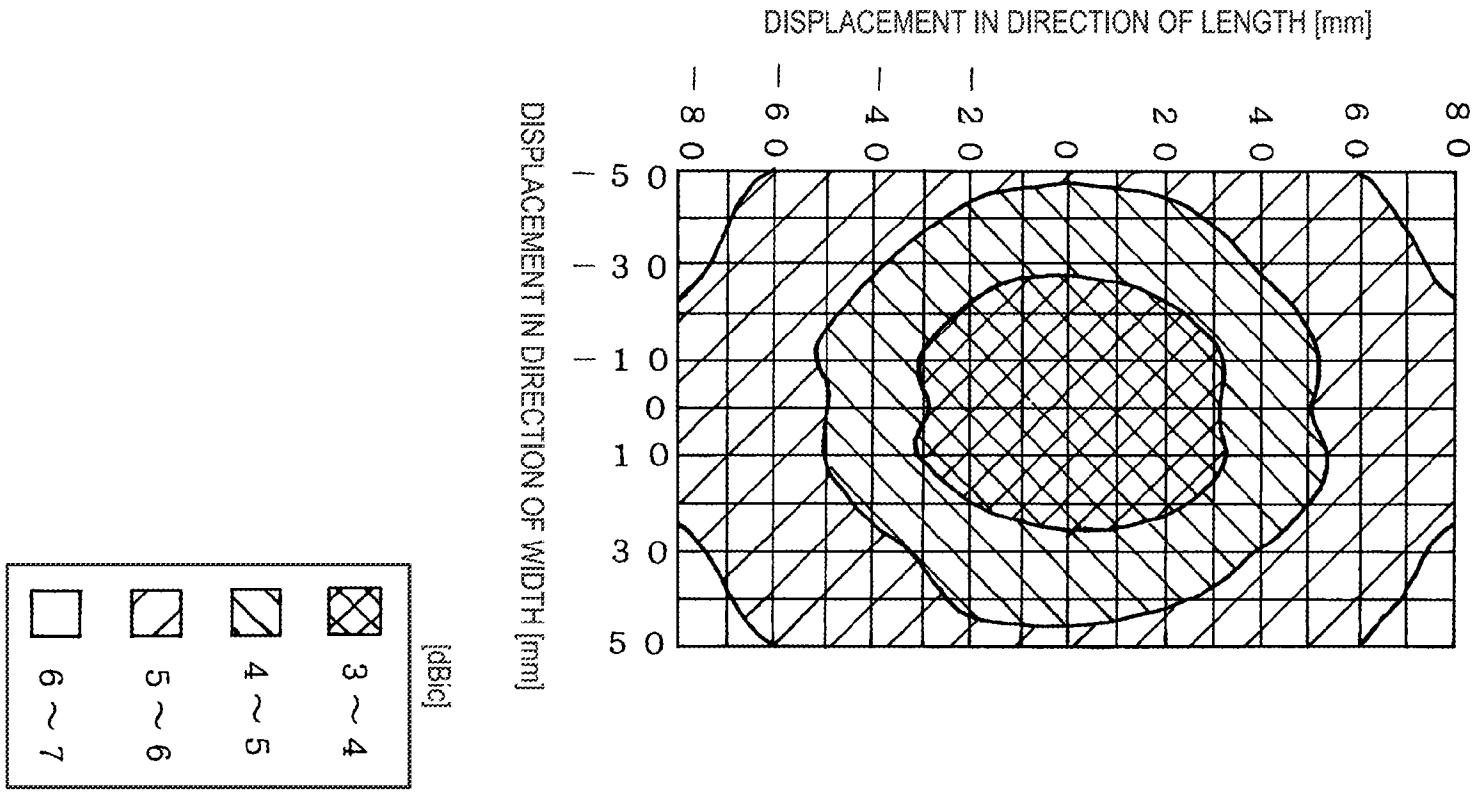
FIG. 15 is a graph showing change of the gain of the GPS patch antenna, in case where a center of the capacity loading plate is displaced from a center of the patch antenna in the directions of width and length, in FIG. 14.

Then, a structure of the capacity loading plate 24 for preventing loss of the gain of the planar antenna disposed below the capacity loading plate 24 will be described. In the measuring model as shown in FIG. 2, the GPS patch antenna 12 is disposed at a center of a ground plane 10 in the same manner as in FIG. 14, and the capacity loading plate 24 is arranged above the GPS patch antenna 12 at a position of the height H of 50 mm. The capacity loading plate 24 is arranged in such a manner that its center is aligned with a center of the GPS patch antenna 12, as seen from above in a plan view. Then, an average gain of the GPS patch antenna 12 at an elevation angle of 10 degree or more was measured, by setting the length L of the capacity loading plate 24 to be 100 mm, a width of the line in the meander shape to be 1 mm, while the width W was varied to 20, 30, 50, 55, 75, and 100 mm, and further, the interval D between the lines in the meander shape was varied to 1, 2.5, and 5 mm. This is because the GPS signals are received at the elevation angle of 10 degree or more, in practical use. The results of measurement are shown in a table in FIG. 3. Further, the results of the measurement as shown in FIG. 3 are shown in a graph in FIG. 4. As shown in the graph in FIG. 4, in a range where the width W is 20, 30, and 50 mm, lines in the graph are substantially overlapped, and the gain is not remarkably changed. However, when the width W becomes 55 mm, the gain is remarkably decreased. It is presumed that the reason is because the width W of 50 mm corresponds to about ¼ wavelength of 1575.42 MHz which is receiving frequency of the GPS patch antenna 12. As for the interval D between the lines in the meander shape, the gain is decreased as the interval becomes larger, but an amount of the decrease is small. Therefore, it is found that the gain is not remarkably influenced by the line interval D.

Moreover, in the measuring model as shown in FIG. 2, the average gain of the GPS patch antenna 12 at the elevation angle of 10 degree or more was measured, by setting the length L of the capacity loading plate 24 to be 100 mm, the width of the line in the meander shape to be 1 mm, and the line interval D to be also 1 mm, while the width W was varied to 20, 30, 40, 50, 55, and 100 mm, and further, the height H was varied to 10, 20, 30, 40 and 50 mm. The results of measurement are shown in a table in FIG. 5. Further, the results of the measurement as shown in FIG. 5 are shown in a graph in FIG. 6. As shown in the graph in FIG. 6, in a range where the width W is 20, 30, and 50 mm, lines in the graph are substantially the same, and the gain is not remarkably changed. However, when the width W becomes 55 mm, the gain is rather decreased. It is presumed that the reason is because the width W of 50 mm corresponds to about ¼ wavelength of 1575.42 MHz which is the receiving frequency of the GPS patch antenna 12. In case where the height H is 20 mm or more, that is, more than about 1/10 wavelength of the receiving frequency of the GPS patch antenna 12, the gain can be considered to be substantially constant.

It is found from the measurement using the measuring model as shown in FIG. 2 that in case where the width W of the capacity loading plate 24 is less than ¼ wavelength of the receiving frequency of the planar antenna which is disposed below, such influence as decreasing the gain is not exerted on a wave deflecting component in the direction of width. Moreover, because the capacity loading plate 24 is set in the meander shape extending in the direction of length, by being folded at the respective edges in the direction of width, the polarized component in the direction of length of the capacity loading plate 24 in the receiving waves of the planar antenna is orthogonal to the lines which are arranged substantially in parallel with each other in the direction of width, and hence, such polarized component is unlikely to be influenced. In addition, portions of the lines which are folded back at the edges in the direction of width are relatively short, and hence, unlikely to be influenced. In this manner, the gain of the planar antenna will not be influenced by the capacity loading plate 24 which is disposed at the upper position.

As described herein above, because the capacity loading plate 24 is formed in the meander shape, the gain of the planar antenna disposed below will not be decreased. Then, influence exerted on characteristics as the FM antenna due to the meander shape of the capacity loading plate 24 was further measured. In a measuring model for measuring the gain as the FM antenna as shown in FIGS. 7A and 7B, the capacity loading plate 24 is disposed at a distal end of the coil element 22 thereby to compose a top capacity loaded type monopole antenna, as the FM antenna. In this measuring model, the gain was measured by setting the width W of the capacity loading plate 24 to be 40 mm, the length L to be 100 mm, while the interval D between the lines in the meander shape was varied to 1, 5, 20 and 50 mm. In the same manner, the gain was measured using a capacity loading plate which is formed in a shape of a single plate having the width W of 40 mm and the length L of 100 mm. As the results, as shown in a graph in FIG. 8, the gains at respective frequencies are substantially the same, even though the interval D between the lines in the meander shape is varied. Moreover, comparing the capacity loading plate 24 in the meander shape with the capacity loading plate in the shape of the single plate, the gains at the respective frequencies are substantially the same. From the results of the measurements, it is found that even though the capacity loading plate 24 is formed in the meander shape and the line interval D is varied, the gain for receiving the FM broadcast is not remarkably changed, and has the same function as the capacity loading plate in the shape of a single plate. In this manner, it is considered that the capacity loading plate 24 does not at all function as a pole antenna in a state extended from the meander shape.

Figure 9:
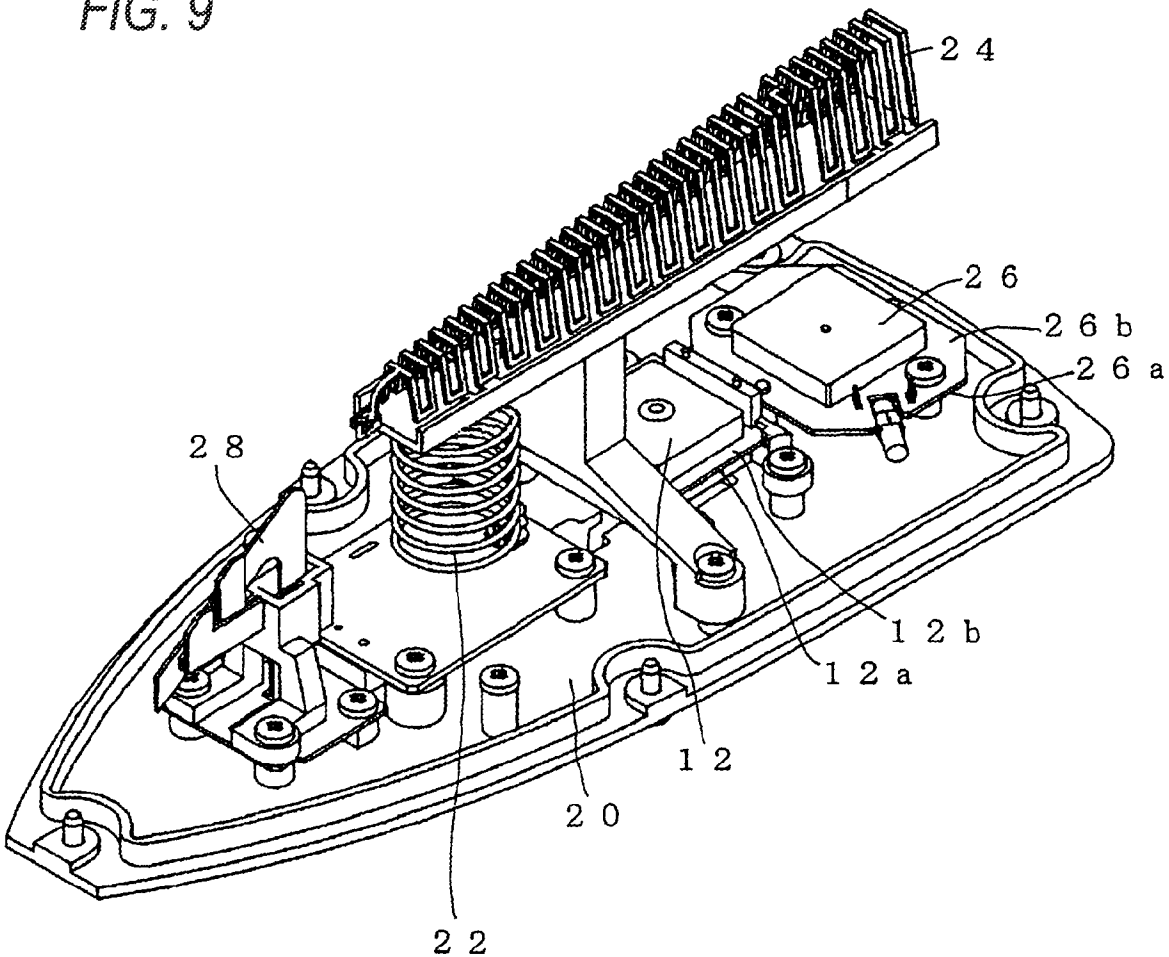
FIG. 9 is a perspective view of an antenna device in a second embodiment of the invention.
Figure 10:
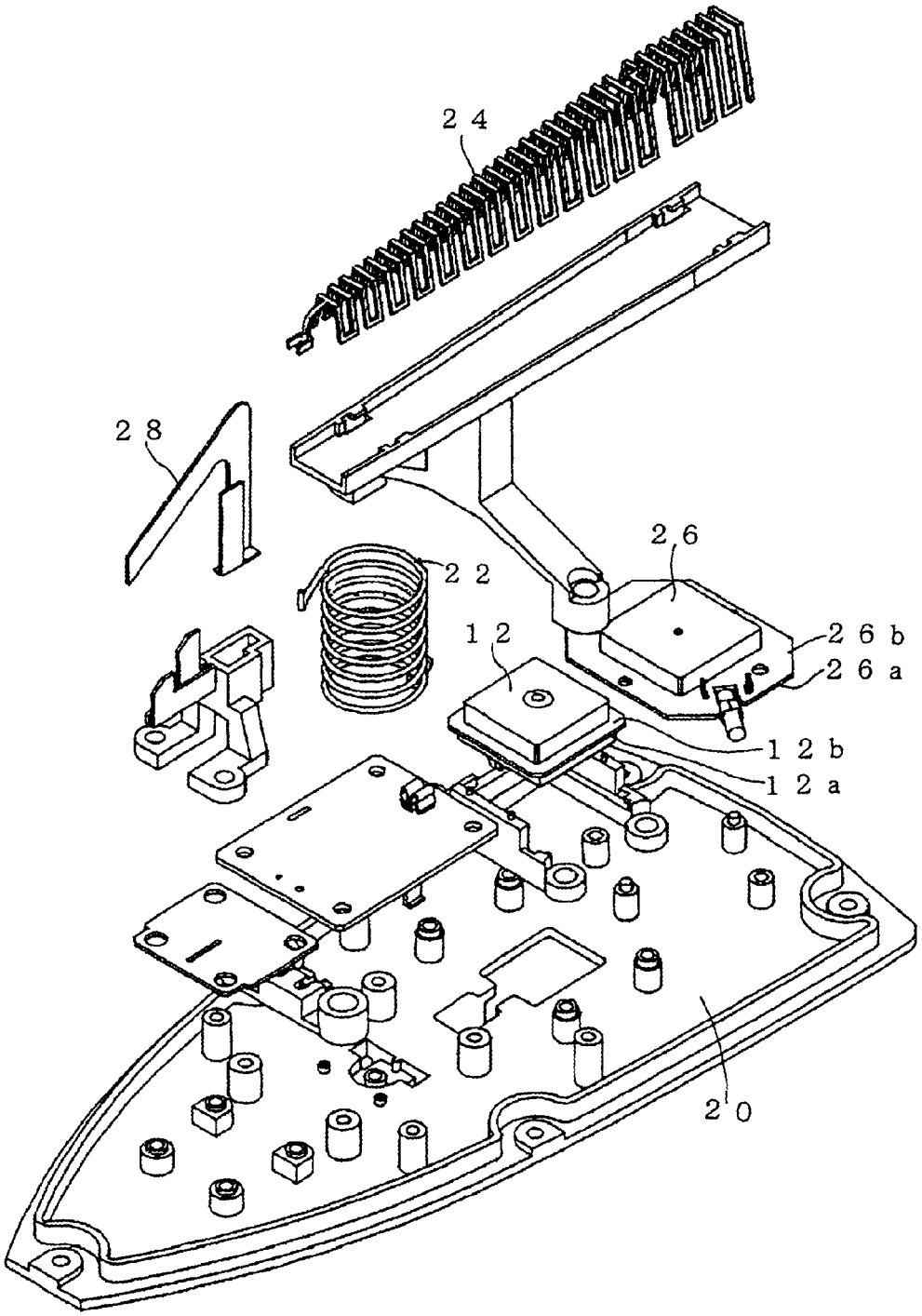
FIG. 10 is an exploded perspective view of the antenna device in FIG. 9.
Figure 11A:
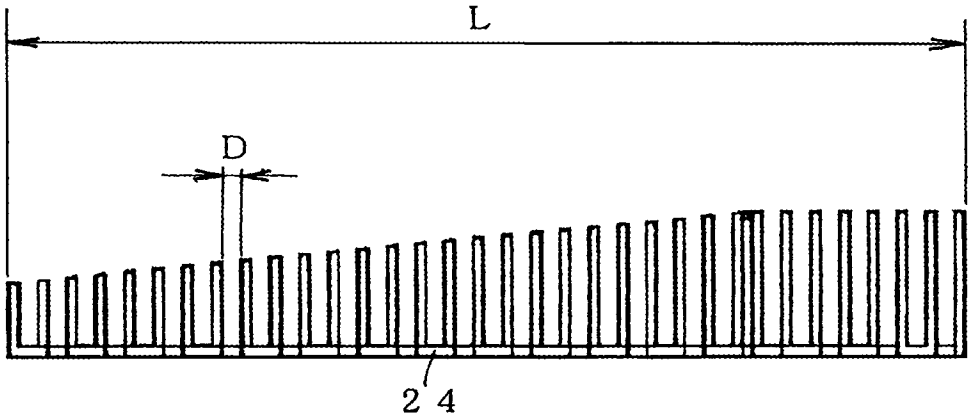
FIG. 11A is a front view showing a structure of a capacity loading plate in the second embodiment.
Figure 11B:
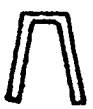
FIG. 11B is an end view of the same at a front end side (a left side)
Figure 11C:
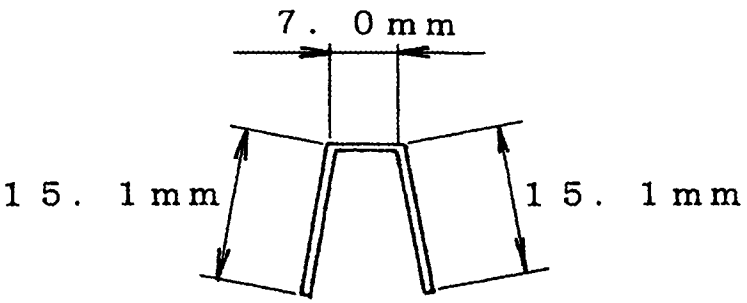
FIG. 11C is an end view of the same at a back end side (a right side).
Figure 12:
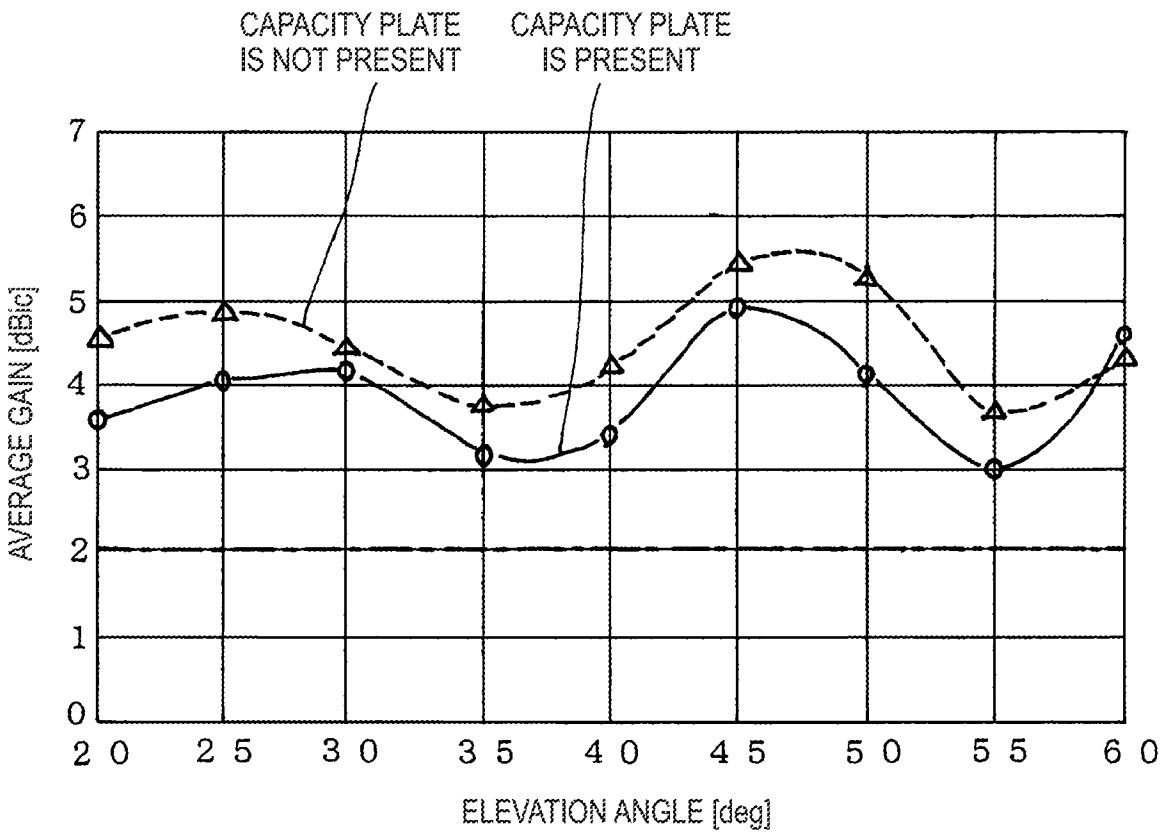
FIG. 12 is a graph showing data of average gains which were measured with respect to an elevation angle of an XM patch antenna (defined later), using the structure in the second embodiment as shown in FIG. 9.
Figure 13:
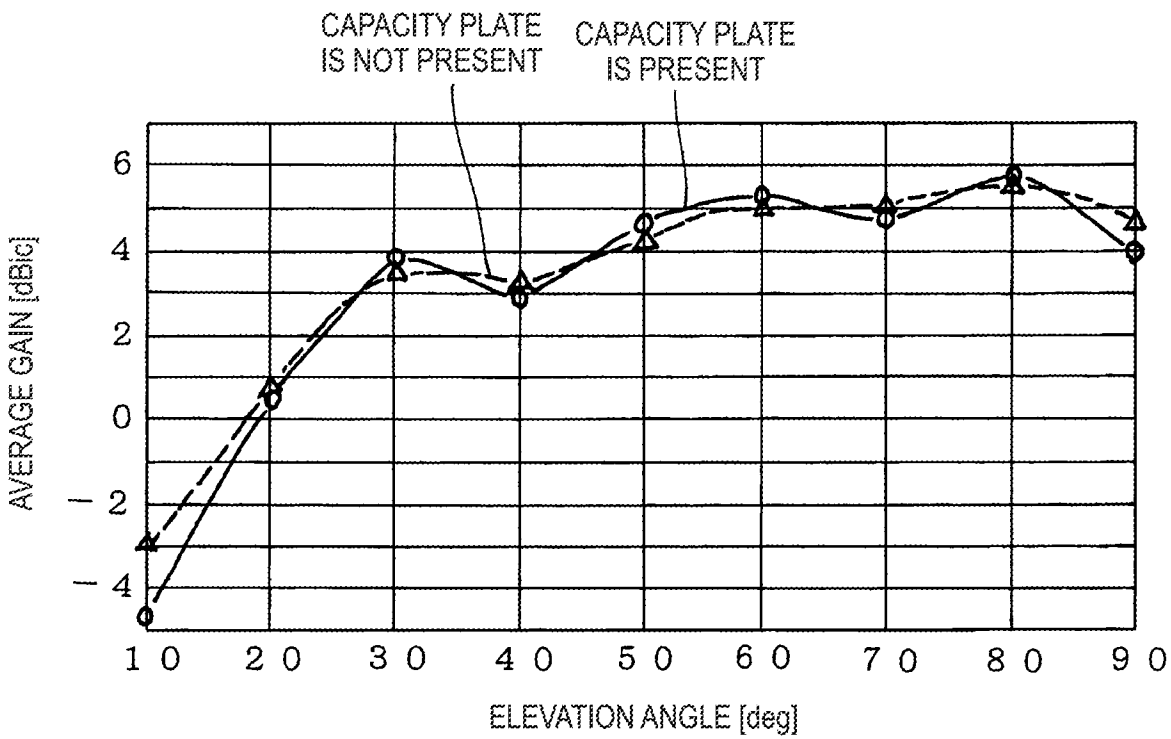
FIG. 13 is a graph showing data of average gains which were measured with respect to an elevation angle of the GPS patch antenna, using the structure in the second embodiment as shown in FIG. 9.

An example of a more practical structure of the antenna device to which the above described findings are applied will be further described as a second embodiment. FIG. 9 is a perspective view of the antenna device in the second embodiment of the invention. FIG. 10 is an exploded perspective view of the antenna device in FIG. 9. FIG. 11A is a front view showing a structure of a capacity loading plate in the second embodiment, FIG. 11B is an end view of the same at a front end side (a left side), and FIG. 11C is an end view of the same at a back end side (a right side). FIG. 12 is a graph showing data of average gains which were measured with respect to an elevation angle of a patch antenna for receiving XM satellite digital radio broadcast (hereinafter referred to as an XM patch antenna), using the structure in the second embodiment as shown in FIG. 9. FIG. 13 is a graph showing data of average gains which were measured with respect to an elevation angle of the GPS patch antenna, using the structure in the second embodiment as shown in FIG. 9. In FIGS. 9, and 11A to 11C, members which are the same or equivalent to those members as shown in FIGS. 1A to 1C are denoted with the same reference numerals and overlapped descriptions will be omitted.

In the antenna device in the second embodiment as shown in FIGS. 9 to 11C, in addition to the GPS patch antenna 12, an XM patch antenna 26 is also disposed on the antenna base plate 20 and below the capacity loading plate 24. The XM patch antenna 26 includes a base plate 26*a* and a ground plane 26*b* which is provided on a whole upper surface of the base plate 26*a*. The capacity loading plate 24 is not formed on one plane, but formed by being folded in a substantially C-shape including two angles in a sectional view which has a convex shape in an upper part, and is opened wider at a lower open side, in such a manner that edges of the capacity loading plate 24 in the direction of width are close to the antenna base plate 20 and a center part thereof in the direction of width is remote from the antenna base plate 20. Moreover, the substantially C-shape including two angles at the back end side as shown in FIG. 11C is larger than the substantially C-shape including two angles at the front end side to be connected to the coil element 22, as shown in FIG. 11B. This shape of the capacity loading plate 24 is in conformity with an outer appearance of the antenna device which is so designed as to grow thinner in the direction of height. As the results, as shown in FIGS. 11A to 11C, the capacity loading plate 24 is set in such a manner that the length L is 99 mm, a total length of a line from one edge to the other edge in the direction of width is 37 mm, at the back end side where the total length is largest, a width of the line in the meander shape is 1 mm, and a line interval D is 2 mm. In case where the capacity loading plate 24 is folded in the direction of width W, as in the second embodiment, it is conjectured that a length along the line from the one edge to the other edge in the direction of width, that is, the width W in a state where the capacity loading plate 24 is developed into a shape of a single flat plate would exert influence on the gain of the planar antenna which is disposed below. Herein, receiving frequency of the satellite digital broadcast to be received by the XM patch antenna 26 is 2345 MHz. In case where the above described findings concerning the structure of the capacity loading plate 24 which would not decrease the gain with respect to the aforesaid GPS patch antenna 12 are applied, it is desirable that the width W in a state where the capacity loading plate 24 is developed into the shape of a single flat plate is less than 30 mm, which is less than ¼ wavelength of the receiving frequency of the satellite digital broadcast to be received by the XM patch antenna 26. However, in the second embodiment, the width W is more than ¼ wavelength in a part in the direction of length, and it is predicted that the gain of the XM patch antenna 26 is decreased.

Then, the gain of the XM patch antenna 26 was measured in the second embodiment as shown in FIG. 9. The results of the measurement are shown in a graph in FIG. 12. In FIG. 12, a case where the capacity loading plate 24 is not present in an upper part is shown by a broken line, while a case where the capacity loading plate 24 is present in the upper part is shown by a solid line. Although the gain is rather decreased because of presence of the capacity loading plate 24, the gains more than 2 dBic which is practically required, as shown by a one dot chain line, are obtained in a range from 20 to 60 degree of the elevation angle. The reason why the gain is rather decreased is because the width of the capacity loading plate 24 at least in a part in the direction of length is more than ¼ wavelength of the receiving frequency of the satellite digital broadcast to be received by the XM patch antenna 26. Moreover, the gain of the GPS patch antenna 12 was also measured. Herein, the width W of 30 mm corresponds to about ⅙ wavelength of 1575.42 MHz of the GPS signal. The results of the measurement are shown in a graph in FIG. 13. In FIG. 13, a case where the capacity loading plate 24 is not present in an upper part is shown by a broken line, while a case where the capacity loading plate 24 is present in the upper part is shown by a solid line. Irrespective of whether the capacity loading plate 24 is present or not present, substantially the same gains are obtained in a range from 20 to 60 degree of the elevation angle.

It is to be noted that in the antenna device, it would be sufficient that practically available gain is only obtained, and the best structure in a technical view need not be necessarily adopted. Therefore, even though the width W is more than ¼ wavelength of the receiving frequency of the planar antenna, it does not matter, provided that required practical sensitivity can be obtained. Moreover, change of the gain of the planar antenna due to variation of the width W of the capacity loading plate 24 is not an abrupt change, when the width W exceeds ¼ wavelength, but a gentle change. Therefore, although a phrase "less than ¼ wavelength" is used in the description of the claims, it would be easily understood that there is an allowance of a certain extent within a range where the technically practical sensitivity can be obtained. Further, the meander shape of the capacity loading plate 24 is not limited to the shape which is formed by being folded back in C-shape including two angles at the edges in the direction of width, but may be such shapes as being folded back in U-shape or in V-shape. It is apparent that the length L and the height H of the capacity loading plate 24 are naturally restricted depending on sizes of the whole outer shape of the antenna device.

According to an aspect of the invention, in the capacity loading plate of the top capacity loaded type monopole antenna to be used as an FM antenna, a size in a direction of width is set to be less than about ¼ wavelength of the receiving frequency of the planar antenna, at least in a part of the capacity loading plate. Therefore, a polarized component in the direction of width of the capacity loading plate in the receiving waves of the planar antenna is unlikely to be influenced by the capacity loading plate. Moreover, the capacity loading plate is formed in the meander shape extending in the direction of length, by being folded back at the edges in the direction of width. Therefore, the polarized component in the direction of length of the capacity loading plate in the receiving waves of the planar antenna is orthogonal to the lines, which are arranged substantially in parallel with each other in the direction of width of the capacity place, out of the meander lines composing the capacity loading plate, and hence, the polarized component is unlikely to be influenced by the capacity loading plate. In addition, portions of the lines which are folded back at the edges in the direction of width are relatively short, and hence, unlikely to be influenced. In this manner, the gain of the planar antenna will not be influenced by the capacity loading plate which is arranged at the upper position.

According to an aspect of the invention, the capacity loading plate is formed by being folded in a convex shape in an upper part in a sectional view, in such a manner that the edges of the capacity loading plate in the direction of width are close to the antenna base plate and a center part thereof in the direction of width is remote from the antenna base plate. Therefore, this structure is suitable for adopting such a design that an outer appearance of the antenna device grows thinner in a direction of height. Moreover, because a length of the line from one edge to the other edge in the direction of width is set to be less than about ¼ wavelength of the receiving frequency of the planar antenna, the polarized component in the direction of width of the capacity loading plate in the receiving waves of the planar antenna is unlikely to be influenced by the capacity loading plate.

What is claimed is:

1. An antenna device comprising:

an antenna base plate having a shape of a flat plate;

a capacity loading plate of a top capacity loaded type monopole antenna, the capacity loading plate arranged in parallel with the antenna base plate; and a planar antenna arranged between the antenna base plate and the capacity loading plate, wherein a size of at least a part of the capacity loading plate in a direction of width of the capacity loading plate is less than about ¼ wavelength of receiving frequency of the planar antenna, and edges of the capacity loading plate in the direction of width of the capacity loading plate are folded back so that the capacity loading plate has a meander shape extending in a direction of length of the capacity loading plate.

2. The antenna device according to claim 1, wherein the edges of the capacity loading plate in the direction of width of the capacity loading plate are closer to the antenna base plate than a center part of the capacity loading plate in the direction of width of the capacity loading plate so that the capacity loading plate has a convex shape, and a length of a line from one edge to the other edge of the capacity loading plate in the direction of width of the capacity loading plate is less than about ¼ wavelength of the receiving frequency of the planar antenna.

* * * * *